US006308520B1

(12) United States Patent
Inoue et al.

(10) Patent No.: US 6,308,520 B1
(45) Date of Patent: Oct. 30, 2001

(54) MULTI-TYPE PULSE-TUBE REFRIGERATING SYSTEM

(75) Inventors: Tatsuo Inoue, Anjo; Masafumi Nogawa, Toyota; Shin Kawano; Kimio Aoyama, both of Kariya, all of (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/450,721

(22) Filed: Nov. 30, 1999

(30) Foreign Application Priority Data

Nov. 30, 1998 (JP) ..... 10-340529

(51) Int. Cl.[7] ..... F25B 9/00
(52) U.S. Cl. ..... 62/6
(58) Field of Search ..... 62/6

(56) References Cited

U.S. PATENT DOCUMENTS 5,412,952 * 5/1995 Ohtani et al. ..... 62/6
5,845,498 * 12/1998 Matsui et al. ..... 62/6
5,927,081 * 7/1999 Li ..... 62/6
5,974,807 * 11/1999 Gao et al. ..... 62/6

FOREIGN PATENT DOCUMENTS 5-45014 2/1993 (JP) .

* cited by examiner

*Primary Examiner*—William Doerrler
(74) *Attorney, Agent, or Firm*—Oblon, Spivak, McClelland, Maier & Neustadt, P.C.

(57) ABSTRACT

A multi-type pulse-tube refrigerating system includes a common compressor 1 having a sucking port 1*b* and a discharging port 1*a*, a plurality of paralleled pressure changeover valve units 21, 22 and 23 connecting between the sucking port 1*b* and the discharging port 1*a* of the compressor 1, and a plurality of pulse-tube based cryogenic temperature generating devices 310, 410 and 510 connected to the respective pressure changeover valve units 21, 22 and 23. Employing such cryogenic temperature generating devices 310, 410 and 510, each of which is void of moving parts, limits vibrations. Moreover, instead of the pressure changeover valve units 21, 22 and 23, employing a common pressure changeover valve unit 24 for the units 21, 22 and 23 makes the refrigerating system more compact.

5 Claims, 11 Drawing Sheets

MULTI-TYPE PULSE-TUBE REFRIGERATING SYSTEM

BACKGROUND OF THE INVENTION

1. Field of the Invention:

The present invention is directed to a multi-type pulse-tube refrigerating system.

2. Discussion of the Background:

A conventional refrigerating system having a plurality of cryogenic temperature generating devices is known as disclosed in Japanese Patent Laid-open No. Hei.5(1993)-45014 published in 1993 without examination.

In the foregoing conventional refrigerating system, each of the cryogenic temperature generating devices is a Gifford-MacMahon type one which is provided with a displacer or piston as an essential element in the vicinity of a cold head. Thus, for generating cryogenic temperature at the cold head of each of the devices, each of the pistons is brought into movement, thereby generating vibrations around the refrigerating system.

Such a conventional refrigerating system may not be acceptable to cool specific substances or items such as a scintillation counter of an energy dispersion type X-ray analyzer. The reason is that the scintillation counter has to be free from vibrations or shocks. Accordingly, a need exists for a refrigerating system without the foregoing drawback.

SUMMARY OF THE INVENTION

It is an object of the present invention to satisfy the need noted above. According to an object of the invention, the above and other objects are achieved by a multi-type pulse tube refrigerating system which comprises a common compressor including a sucking port and a discharging port; a plurality of parallel pressure changeover valve units connecting between the sucking port and the discharging port of the common compressor; and a plurality of pulse-tube based cryogenic temperature generating devices connected to the respective pressure changeover valve units.

BRIEF DESCRIPTION OF THE DRAWINGS

These and other features and advantages of the present invention will be more readily apprehended from the following detailed description when read in connection with the appended drawings, which form a part of this original disclosure, and wherein.

DESCRIPTION OF THE PREFERRED EMBODIMENTS

First Embodiment

Figure 1:
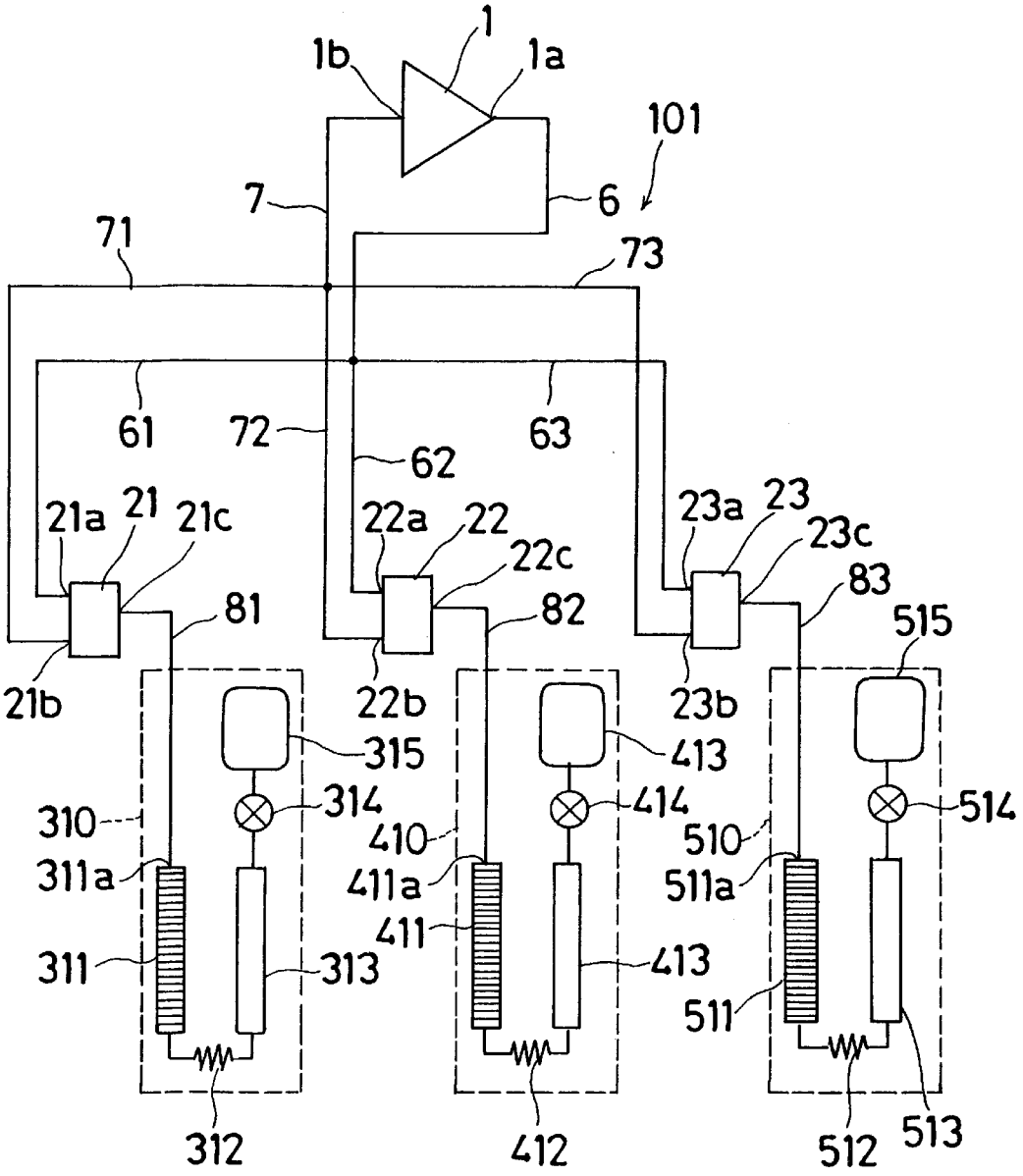
FIG. 1 is a schematic diagram of a multi-type pulse-tube refrigerating system in accordance with a first embodiment of the present invention.

With reference to FIG. 1, there is illustrated a multi-type pulse-tube refrigerating system 101 in accordance with a first embodiment of the present invention.

The multi-type pulse-tube refrigerating system 101 includes a common compressor 1 which has a discharging port 1*a* and a sucking port 1*b*. The discharging port 1*a* of the compressor 1 is connected with a high pressure line 6 from which three high pressure lines: a first high pressure line 61, a second high pressure line 62 and a third high pressure line 63, are extended or tapped, while the sucking port 1*b* of the compressor 1 is connected with a low pressure line 7 from which three low pressure lines: a first low pressure line 71, a second low pressure line 72 and a third low pressure line 73, are extended or tapped.

The first high pressure line 61, the second high pressure line 62 and the third high pressure line 63 are connected to a high-pressure inlet port 21*a* of a first pressure changeover valve unit 21, a high-pressure inlet port 22*a* of a second pressure changeover valve unit 22 and a high-pressure inlet port 22*a* of a third pressure changeover valve unit 23, respectively, while the first low pressure line 71, the second low pressure line 72 and the third low pressure line 73 are connected to a low-pressure inlet port 21*b* of the first pressure changeover valve unit 21, a low-pressure inlet port 22*b* of the second pressure changeover valve unit 22 and a low-pressure inlet port 23*b* of the third pressure changeover valve unit 23, respectively.

The first pressure changeover valve unit 21, the second pressure changeover valve unit 22 and the third pressure changeover valve unit 23 have an outlet port 21*c*, an outlet port 22*c* and an outlet port 23*c*, respectively. In each of the pressure changeover valve units 21, 22 and 23, there is provided a motor-driven mechanism (not shown) for alternate connection of the outlet port of each respective valve to either the high-pressure inlet port or the low-pressure outlet port.

The first pressure changeover valve unit 21 is connected via a first line 81 to a first cryogenic temperature generating device 310 which includes a regenerator 311, a cold head 312 to be in thermal engagement with a substance (not shown) for cooling the same, a pulse tube 313, an orifice 314 and a buffer tank 315 which are arranged in such an order. One end 311*a* of the regenerator 311 is connected via the first line 81 to the outlet port 21*c* of the first changeover valve unit 21. It is to be noted that a continuous space (not indicated) which extends from the line 81 to the pulse tube 313 defines an operating space of the first cryogenic temperature generating device 310.

The second pressure changeover valve unit 22 is connected via a second line 82 to a second cryogenic temperature generating device 410 which includes a regenerator 411, a cold head 412 to be in thermal engagement with a substance (not shown) for cooling the same, a pulse tube 413, an orifice 414 and a buffer tank 415 which are arranged in such an order. One end 411*a* of the regenerator 411 is connected via the first line 82 to the outlet port 21*c* of the second changeover valve unit 22. It is to be noted that a continuous space (not indicated) which extends from the line 82 to the pulse tube 413 defines an operating space of the second cryogenic temperature generating device 410.

The third pressure changeover valve unit 23 is connected via a first line 83 to a third cryogenic temperature generating device 510 which includes a regenerator 511, a cold head 512 to be in thermal engagement with a substance (not shown) for cooling the same, a pulse tube 513, an orifice 514 and a buffer tank 515 which are arranged in such an order. One end 511*a* of the regenerator 511 is connected via the first line 83 to the outlet port 23*c* of the third changeover valve unit 23. It is to be noted that a continuous space (not indicated) which extends from the line 83 to the pulse tube 513 defines an operating space of the second cryogenic temperature generating device 510.

In the foregoing structure, simultaneous with turning on the compressor 1, the driving motors of the respective pressure changeover valve unit 21, 22 and 23 are also turned on, high and low pressures are supplied alternately to each of the operating spaces of the respective cryogenic temperature generating devices 310, 410 and 510. Cryogenic temperatures are generated at and around the respective cold heads 312, 412 and 512 if a phase difference between the resultant pressure change and a displacement of the fluid in the operating space is optimized with the use of the orifices 314, 414 and 514 and the buffer tanks 315, 415 and 515, thereby cooling substances which are in thermal contact with the respective cold heads 312, 412 and 512.

Due to the fact that the foregoing cryogenic temperature generation is made with the use of the pulse-tube based cryogenic temperature generating device which is void of moving parts near the cold head, the cold head can cool a substance which has to be free from vibrations.

Second Embodiment

Figure 2:
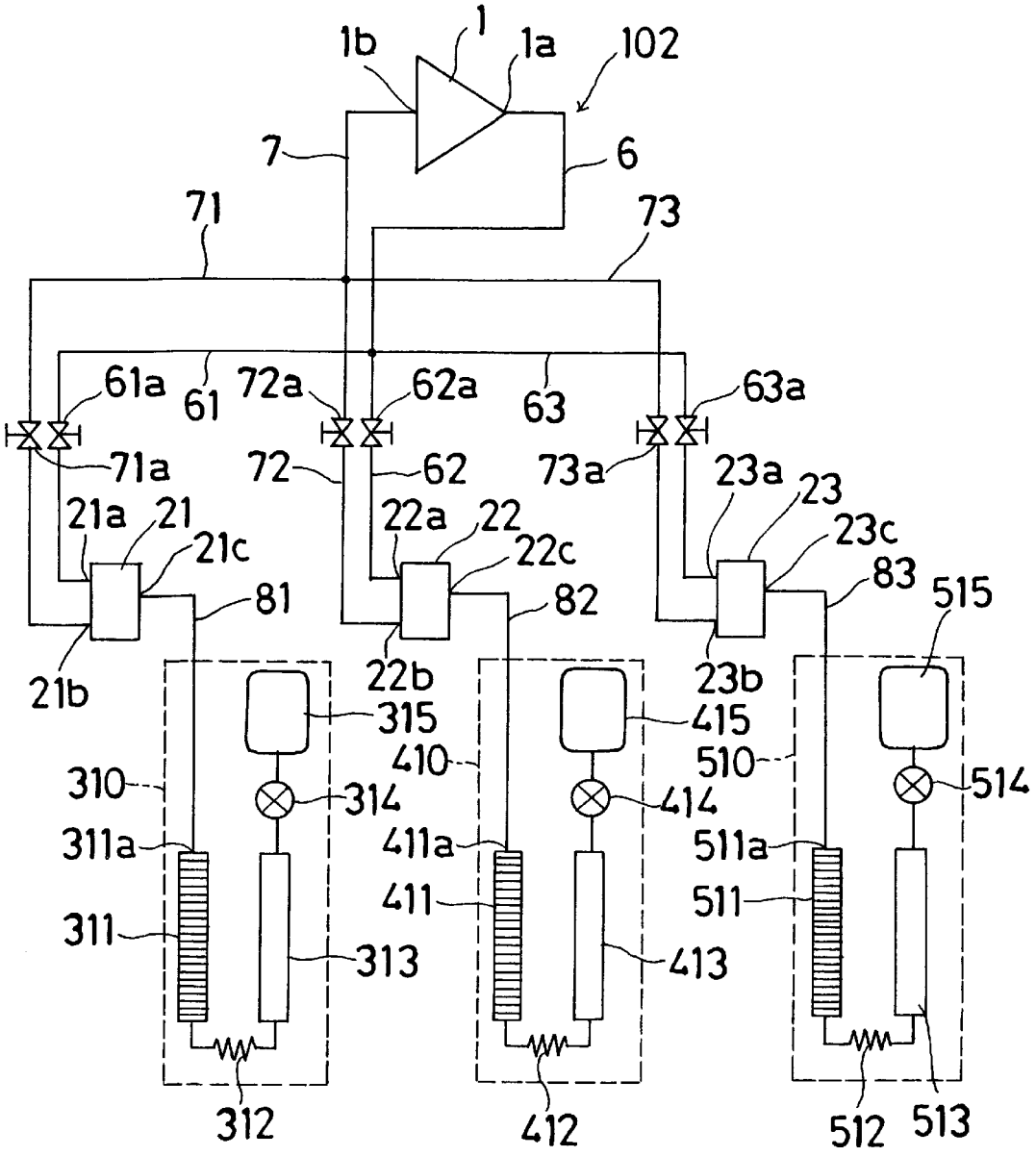
FIG. 2 is a schematic diagram of a multi-type pulse-tube refrigerating system in accordance with a second embodiment of the present invention.

With reference to FIG. 2, there is illustrated a multi-type pulse-tube refrigerating system 102 in accordance with a second embodiment of the present invention.

In this embodiment, a first high-pressure open-close valve 61*a*, a second high-pressure open-close valve 62*a* and a third high-pressure open-close valve 63*a* are disposed at mid portions of the first high pressure line 61, the second high pressure line 62 and the third line 63, respectively, while a first low-pressure open-close valve 71*a*, a second low-pressure open-close valve 72*a* and a third low-pressure open-close valve 73*a*, are disposed at midw portions of the first low pressure line 71, the second low pressure line 72 and the third low pressure line 73, respectively. The remaining structure of this embodiment is identical with that of the first embodiment, which requires no further explanation thereof.

In the foregoing structure, simultaneous with turning on the compressor 1, the driving motors of the respective pressure changeover valve unit 21, 22 and 23 are also turned on and alternative high and low pressures are supplied to each of the operating spaces of the respective cryogenic temperature generating devices 310, 410 and 510. Cryogenic temperatures are generated at and around the respective cold heads 312, 412 and 512 if a phase difference between the resultant pressure change and a displacement of the fluid in the operating space is optimized with the use of the orifices 314, 414 and 514, and the buffer tanks 315, 415 and 515, thereby cooling substances which are in thermal contact with the respective cold heads 312, 412 and 512, respectively.

Due to the fact that the foregoing cryogenic temperature generation is made with the use of the pulse-tube based cryogenic temperature generating device which is void of moving parts near the cold head, the cold head can cool a substance which has to be free from vibrations.

In addition, when a set of the open-close valves 61*a* and 61*b*, a set of the open-close valves 62*a* and 62*b* and a set of the open-close valves 63*a* and 63*b* are closed, respectively, the cryogenic temperature generating devices 310, 410 and 510 become inoperative, which permits selective and individual operation of each of the cryogenic generating devices 310, 410 and 510. It is to be noted that while one or two cryogenic generating devices are inoperative with the remaining one or ones being in operation, a replacement of the substance to be cooled at the inoperative cryogenic temperature device(s) can be made or the inoperative cryogenic temperature device(s) can be warmed. Warming the cryogenic temperature device is required before a maintenance operation due to the fact that maintenance of the cryogenic temperature device whose cold head is at a low temperature is difficult. Where the cryogenic temperature device is associated with a cryogenic temperature panel of a cryogenic pump, the cold head sometimes has to be warmed up to a temperature for warming the cryogenic panel.

Third Embodiment

Figure 3:
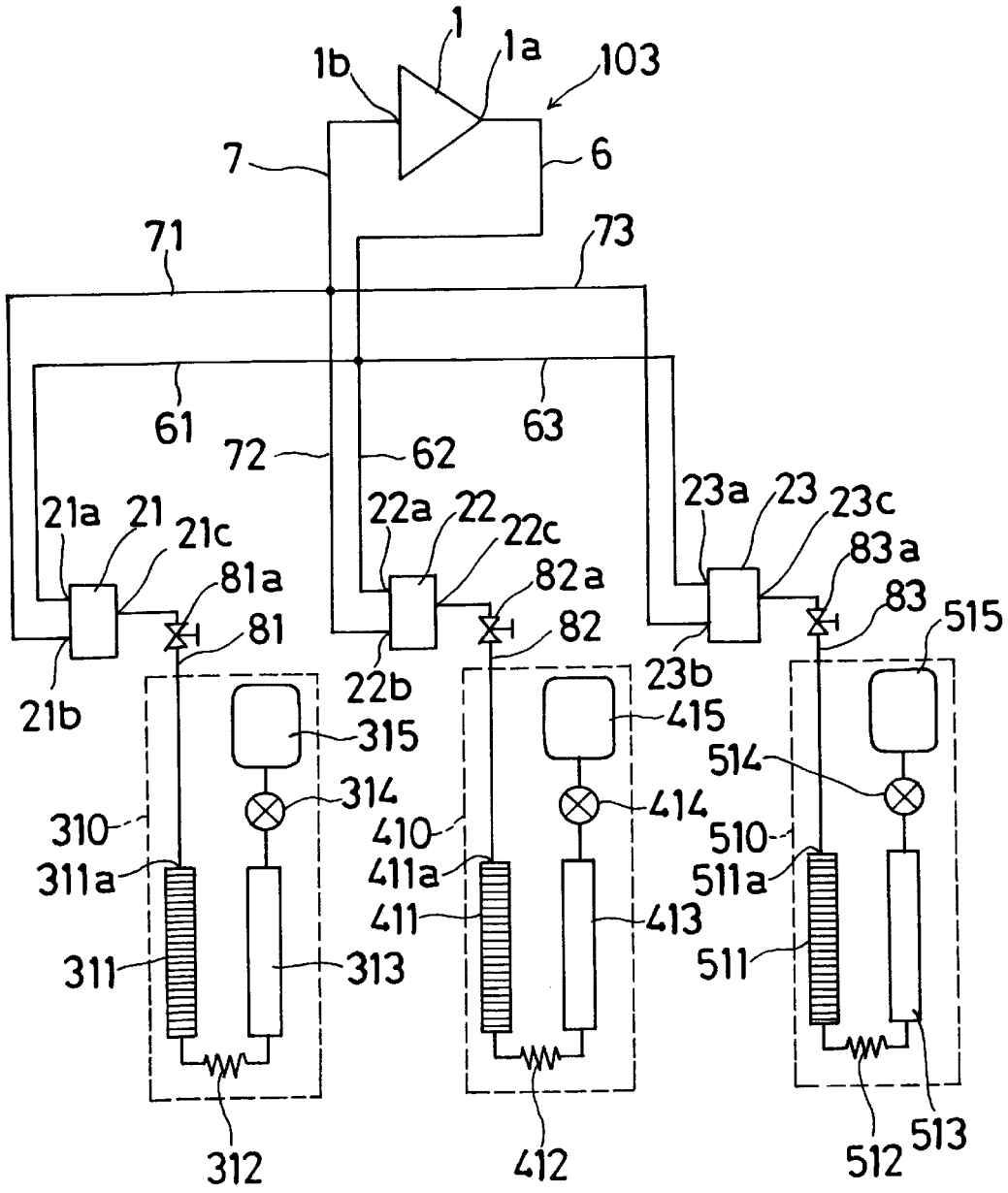
FIG. 3 is a schematic diagram of a multi-type pulse-tube refrigerating system in accordance with a third embodiment of the present invention.

With reference to FIG. 3, there is illustrated a multi-type pulse-tube refrigerating system 103 in accordance with a third embodiment of the present invention. This embodiment is identical with the second embodiment in structure, operation and effects except that instead of the set of the valves 61*a* and 71*a*, the set of the valves 62*a* and 72*a* and the set of the valves 63*a* and 73*a* of the second embodiment, pressure control open-close valves 81*a*, 82*a* and 83*a*, respectively, are disposed in the first line 81, the second line 82 and the third line 93, respectively. Employing such a structure permits the number of valves, per se, and correspondingly the number of operations, to be decreased when compared with the second embodiment.

Fourth Embodiment

Figure 4:
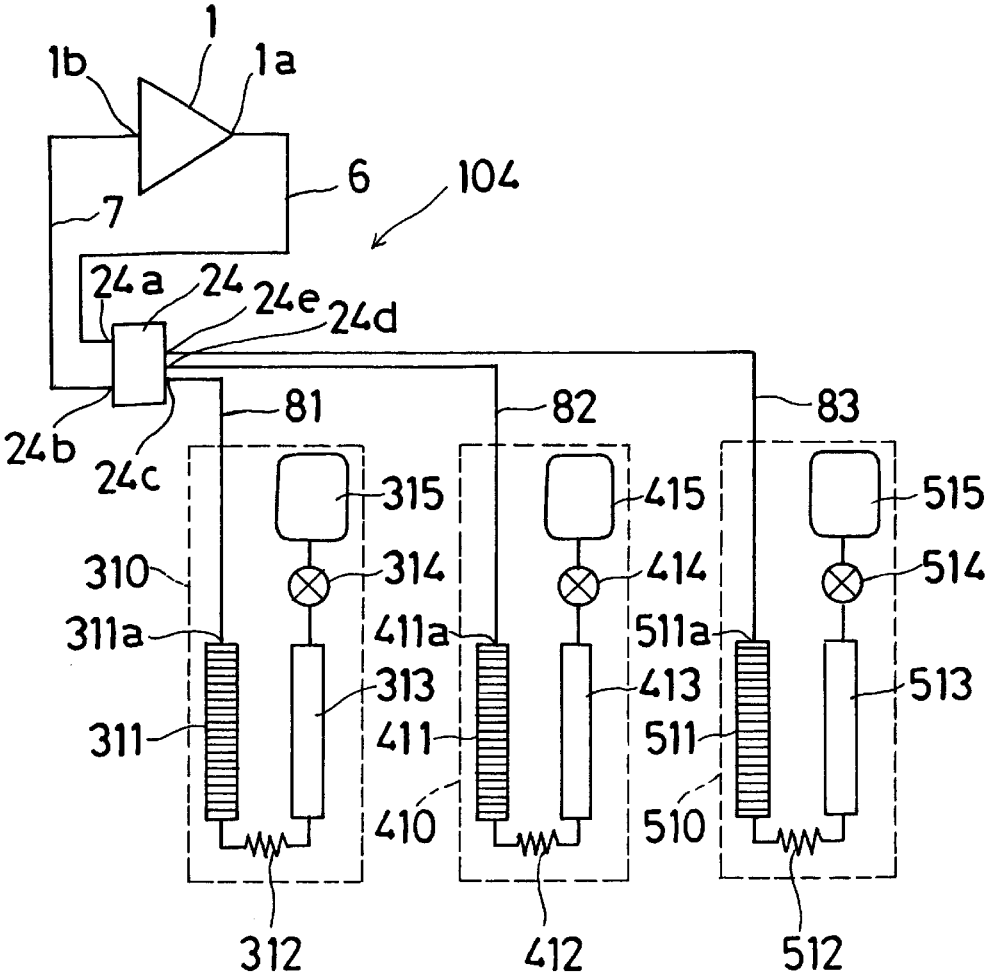
FIG. 4 is a schematic diagram of a multi-type pulse-tube refrigerating system in accordance with a fourth embodiment of the present invention.

With reference to FIG. 4, there is illustrated a multi-type pulse-tube refrigerating system 104 in accordance with a fourth embodiment of the present invention. The multi-type pulse-tube refrigerating system 104 includes a common compressor 1 which has a discharging port 1*a* and a sucking port 1*b*. The discharging port 1*a* of the compressor 1 are connected to a high pressure inlet 24*a* of a common pressure changeover valve unit 24 by way of a high pressure line 6, while the sucking port 1*b* of the compressor 1 is connected to a low pressure inlet port 24*b* of the pressure changeover valve unit 24.

The pressure changeover valve unit 24 includes a first outlet port 24*a*, a second outlet port 24*b* and a third outlet port 24*c*. The first outlet port 24*a* of the pressure changeover valve unit 24 is connected via a first line 81 to a first cryogenic temperature generating device 310 which includes a regenerator 311, a cold head 312 to be in thermal engagement with a substance (not shown) for cooling the same, a pulse tube 313, an orifice 314 and a buffer tank 315 which are arranged in such an order. One end 311*a* of the regenerator 311 is connected via the first line 81 to the outlet port 21*c* of the first changeover valve unit 21. It is to be noted that a continuous space (not indicated) which extends from the line 81 to the pulse tube 313 defines an operating space of the first the first cryogenic temperature generating device 310.

The second outlet port 24*b* of the pressure changeover valve unit 24 is connected via a second line 82 to a second cryogenic temperature generating device 410 which includes a regenerator 411, a cold head 412 to be in thermal engagement with a substance (not shown) for cooling the same, a pulse tube 413, an orifice 414 and a buffer tank 415 which are arranged in such an order. One end 411*a* of the regenerator 411 is connected via the first line 82 to the outlet port 21*c* of the second changeover valve unit 22. It is to be noted that a continuous space (not indicated) which extends from the line 82 to the pulse tube 413 defines an operating space of the second cryogenic temperature generating device 410.

The third outlet port 24*c* of the pressure changeover valve unit 24 is connected via a first line 83 to a third cryogenic temperature generating device 510 which includes a regenerator 511 , a cold head 512 to be in thermal engagement with a substance (not shown) for cooling the same, a pulse tube 513, an orifice 514 and a buffer tank 515 which are arranged in such an order. One end 511*a* of the regenerator 511 is connected via the first line 83 to the outlet port 23*c* of the third changeover valve unit 23. It is to be noted that a continuous space (not indicated) which extends from the line 83 to the pulse tube 513 defines an operating space of the second cryogenic temperature generating device 510.

Figure 5:
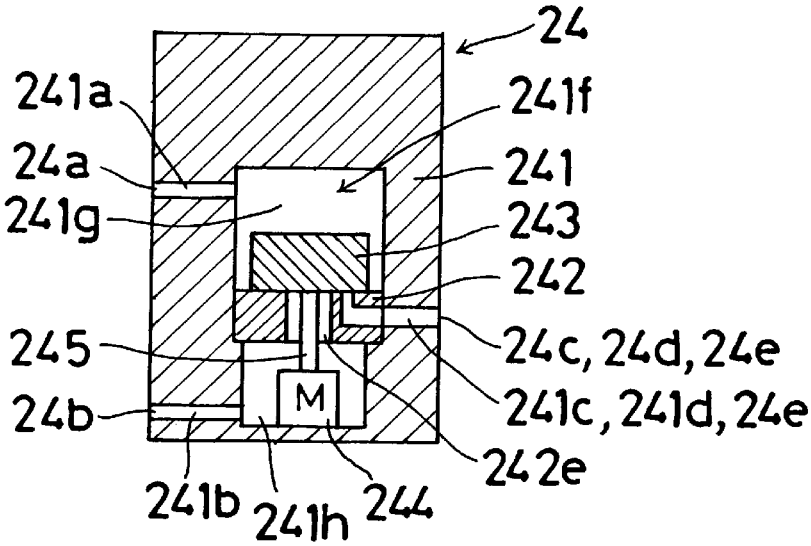
FIG. 5 is a cross-sectional view of a pressure changeover valve unit for use in the multi-type pulse-tube refrigerating system shown in FIG. 4.

Referring to FIG. 5, there is illustrated an internal structure of the pressure changeover valve unit 24 in cross-section. The pressure changeover valve unit 24 includes, as its major elements, a housing 241 formed therein with an inner space 241*f*, a valve seat 242, a rotor 243, a driving motor 244 and a shaft 255.

The pressure changeover valve unit 24 has a profile of a cylindrical shape. A circular side wall is provided therein with a high pressure inlet port 24*a*, a low-pressure inlet port 24*b*, a first outlet passage 241*c* which terminates in a first outlet port 24*c*, a second outlet passage 241*d* which terminates in an outlet port 24*d* and a third outlet passage 241*d* which terminates in an outlet port 24*e*.

In the inner space 241*f* of the valve housing 24, there is provided the valve seat 242, which defines a high pressure chamber 241*g* and a lower pressure chamber 241*h* which are fluid tightly separated from each other in such a manner that the former and the latter take an upper position and a lower position, respectively.

Figure 6:
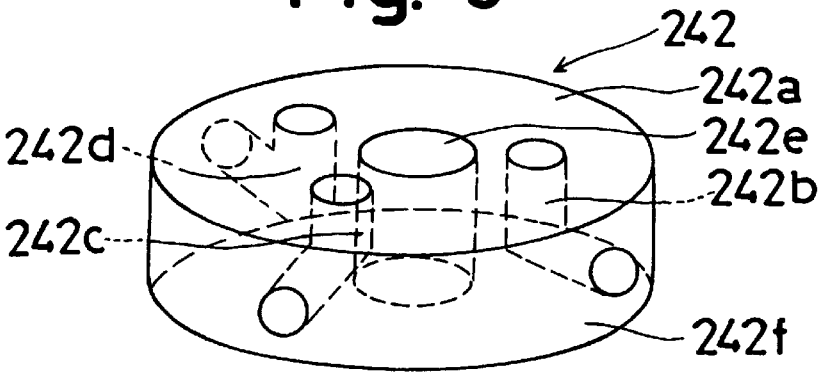
FIG. 6 is a perspective view of a valve seat of the changeover valve unit shown in FIG. 5.

As can be seen from FIG. 6, the valve seat 242 is in the form of a circular plate having an axial passage 242*a*. The valve seat 242 is also formed therein with three equi-spaced communication passages: a first communication passage 242*b*, a second communication passage 242*c* and a third communication passage 242*d* which are elbow-shaped. One end of the first communication passage 242*b*, one end second communication passage 242*c* and one end of the third communication passage 242*d* are exposed to the high pressure chamber 241*g*, while the other end of the first communication passage 242*b*, the other end of the second communication passage 242*c* and the other end of the third communication passage 242d are in continuous fluid communication with the first communication passage 241*c*, the second communication passage 241*d* and the third communication passage 241*d*, respectively.

Figure 7:
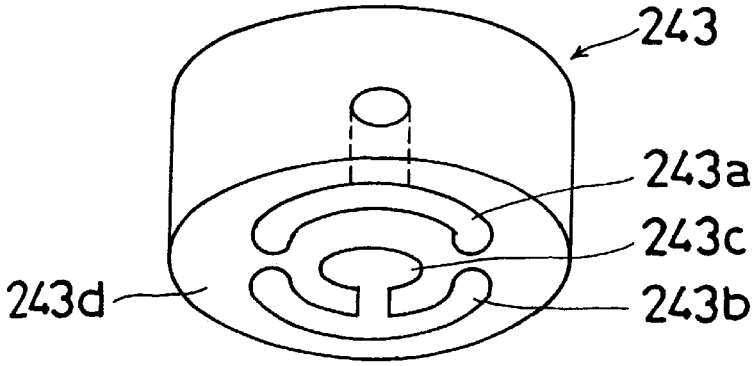
FIG. 7 is a perspective view of a rotor of the changeover valve unit shown in FIG. 5.

As shown in FIG. 7, the rotor 243 is a circular-shaped plate and is formed at its lower surface with a high pressure slit 243*a* which is arc-shaped and a low pressure slit 243*b* which is arc-shaped. The lower surface of the rotor 243 is provided with a center blind bore 243*c* which is continued to the low pressure slit 243*b*. The high pressure slit 243*a*, the low pressure slit 243*b* and the bore 243 have a common axis. At an upper surface of the rotor 243, the high pressure slit 243*a* terminates at the high pressure chamber 241*g*. The low pressure slit 243*b* is, like the bore 243*c*, in the form of a blind bore.

As shown in FIG. 5, the rotor 243 is mounted on the valve seat 242 in such a manner that the lower surface 243*d* of the rotor 243 is in coaxial contact with the upper surface of the valve seat 242. Thus, the high pressure slit 243*a* of the rotor 243 becomes in continuous fluid communication with the high pressure chamber 241*g*, thereby keeping a high pressure condition in the high pressure slit 243*a*. On the other hand, the low pressure slit 243*b* becomes in continuous fluid communication with the low pressure chamber 241*h* by way of the bore 242*e*.

The motor 244 has an output shaft (not shown) to which a lower end of the shaft 245 is connected. The shaft 245 extends through the bore 242*e* and the other end of the shaft 245 is fitted snugly in the bore 243*c* of the rotor 243.

In the foregoing structure, when turning on the compressor 1, the driving motor 244 housed in the pressure changeover valve unit 24 is also turned on, alternative high and low pressures are supplied to the operating spaces in the respective cryogenic temperature generating devices 310, 410 and 510. Cryogenic temperatures are generated at and around the respective cold heads 312, 412 and 512 if a phase difference between the resultant pressure change and a displacement of the fluid in the operating space is optimized with the use of the orifices 314, 414 and 514 and the buffer tanks 315, 415 and 515, thereby cooling substances which are in thermal contact with the respective cold heads 312, 412 and 512.

Figure 8:
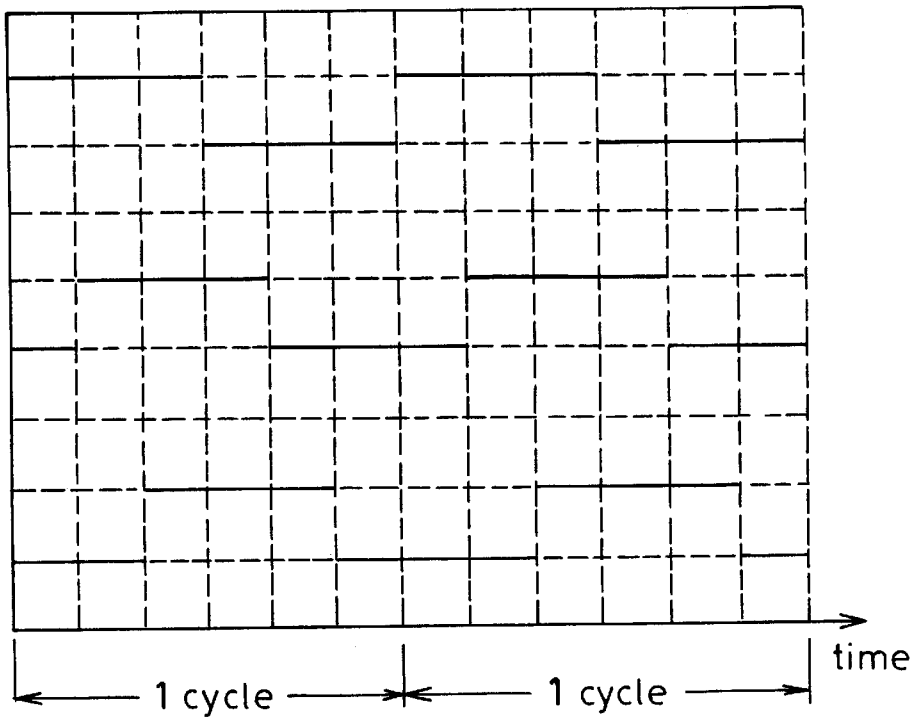
FIG. 8 is a graph which indicates fluid pressure change conditions while the multi-type pulse-tube refrigerating system shown in FIG. 4 is in operation.

As apparent from FIG. 8, during the foregoing operation, the connection of the first line 81 with the high pressure chamber 241*f* in the pressure changeover valve unit 24, the connection of the second line 82 with the high pressure chamber 241*f* in the pressure changeover valve unit 24, the connection of the third line 83 with the high pressure chamber 241*f* in the pressure changeover valve unit 24, the connection of the first line 81 with the low pressure chamber 241*h* in the pressure changeover valve unit 24, the connection of the second line 82 with the low pressure chamber 241*h* in the pressure changeover valve unit 24 and the connection of the third line 83 with the low pressure chamber 241*h* in the pressure changeover valve unit 24 are cyclically established in such a manner that an interval between two adjacent connections is substantially 60 degrees in phase.

Due to the fact that the foregoing cryogenic temperature generation is made with the use of the pulse-tube based cryogenic temperature generating device which is void of moving parts near the cold head, the cold head may cool a substance which has to be free from vibrations. In addition, the cryogenic temperature devices 310, 410 and 510 are allowed to share the sole common pressure changeover valve unit 24 in which only one motor 244 is installed, which enables the multi-type pulse tube refrigerating system to be more compact or miniaturized.

Fifth Embodiment

Figure 9:
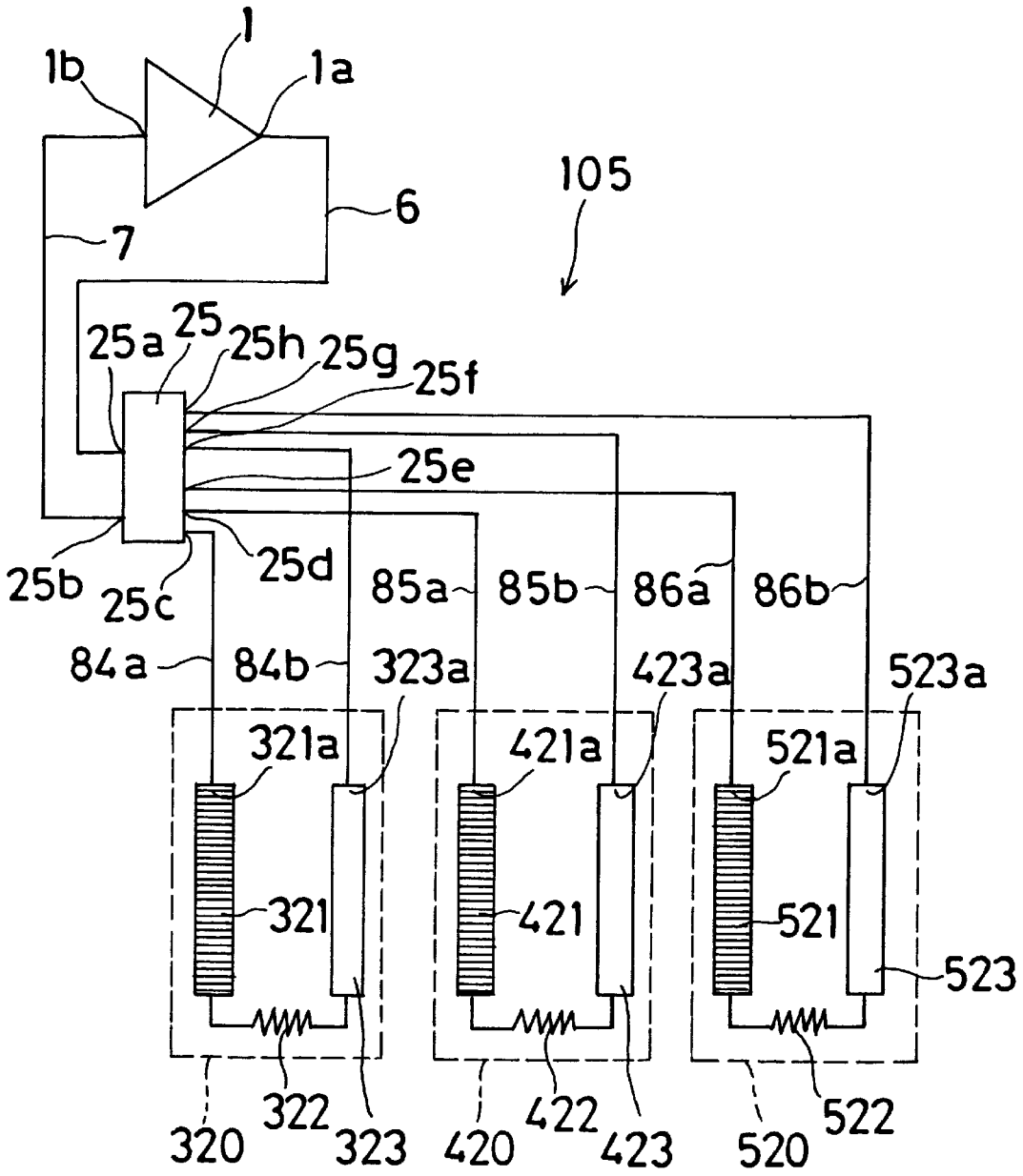
FIG. 9 is a schematic diagram of a multi-type pulse-tube refrigerating system in accordance with a fifth embodiment of the present invention.

With reference to FIG. 9, there is illustrated a multi-type pulse-tube refrigerating system 105 in accordance with a fifth embodiment of the present invention.

The multi-type pulse-tube refrigerating system 105 includes a common compressor having a discharging port 1*a* and a sucking port 1*b*. The discharging port 1*a* of the compressor 1 is connected with a high pressure line 6 which is connected to a high pressure inlet port 25*a* of a common pressure changeover valve unit 25, while the sucking port 1*b* of the compressor 1 is connected with a low pressure line 7 which is connected to a low pressure inlet port 25*b* of the pressure changeover valve unit 25. Thus, by way of the high and low pressure lines 6 and 7, the pressure changeover valve unit 25 is connected across the compressor 1.

The pressure changeover valve unit 25 is connected to three cryogenic temperature generating devices: a first cryogenic temperature generating device 320, a second cryogenic temperature generating device 420 and a third cryogenic temperature generating device 420.

The first cryogenic temperature generating device 320 includes a series connection of a regenerator 321, a cold head 322 and a pulse tube 323 which are arranged in such an order. An end 321*a* of the regenerator 321 is connected to a first high pressure outlet port 25*c* of the pressure changeover valve unit 25 by way of a first regenerator side line 84*a*, while an end of the pulse tube 323 is connected to a first low pressure outlet port 25*f* of the pressure changeover valve unit 25 by way of a first pulse-tube side line 84*b*.

The second cryogenic temperature generating device 420 includes a series connection of a regenerator 421, a cold head 422 and a pulse tube 423 which are arranged in such an order. An end 421*a* of the regenerator 421 is connected to a second high pressure outlet port 25*d* of the pressure changeover valve unit 25 by way of a second regenerator side line 85*a*, while an end of the pulse tube 423 is connected to a second low pressure outlet port 25*g* of the pressure changeover valve unit 25 by way of a second pulse-tube side line 85*b*.

The third cryogenic temperature generating device 520 includes a series connection of a regenerator 521, a cold head 522 and a pulse tube 523 which are arranged in such an order. An end 521*a* of the regenerator 521 is connected to a third high pressure outlet port 25*e* of the pressure changeover valve unit 25 by way of a third regenerator side line 86*a*, while an end of the pulse tube 523 is connected to a third low pressure outlet port 25*h* of the pressure changeover valve unit 25 by way of a third pulse-tube side line 85*c*.

Figure 10:
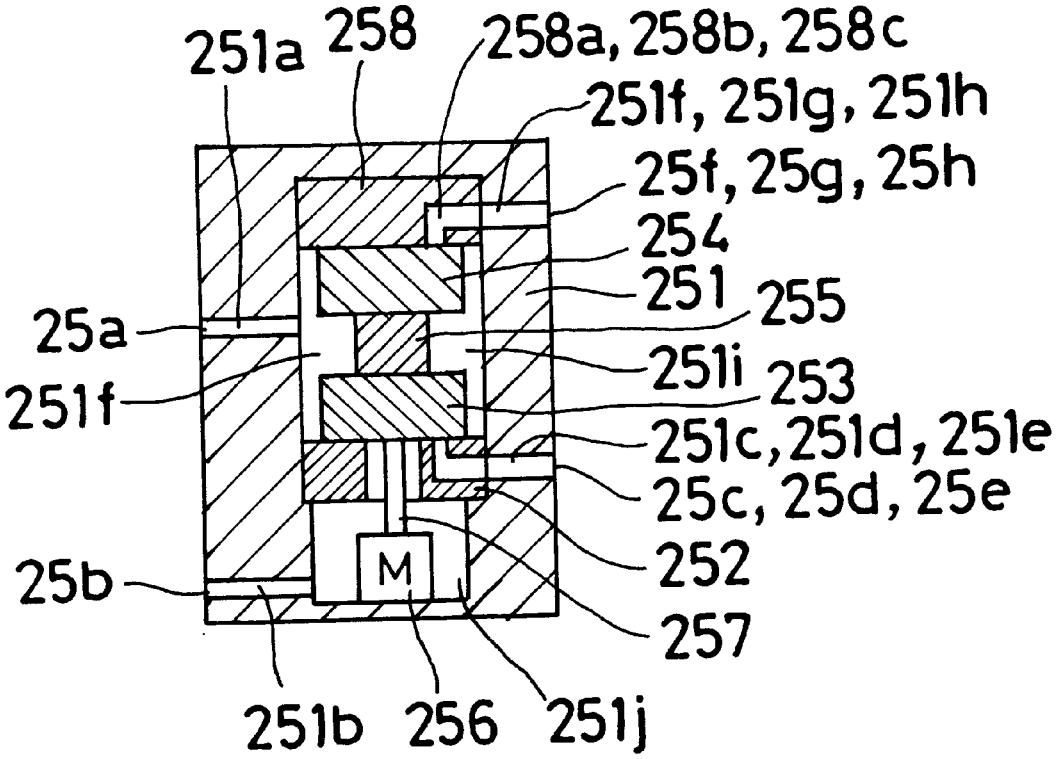
FIG. 10 is a cross-sectional view of a pressure changeover valve unit for use in the multi-type pulse-tube refrigerating system shown in FIG. 9.

Referring to FIG. 10, there is illustrated an internal structure of the pressure changeover valve unit 25 in cross-section. As can be understood from the illustration in FIG. 10, the pressure changeover valve unit 25 includes, as its major elements, a housing having an internal space 251*f*, a valve seat 252 accommodated in the internal space 251*f*, a regenerator side or upper rotor 253, a pulse-tube side or lower rotor 254, a connector 255 connecting between the rotors 253 and 254, a shaft 257 and a passage block 258.

The housing 251 has a profile of a cylindrical shape in which the internal space 251*f* is defined. The housing 251 is provided at its side wall with a high pressure inlet port 25*a*, a low pressure inlet port 25*b*, a first regenerator side outlet port 25*c*, a second regenerator side outlet port 25*d*, a third regenerator side outlet port 25*e*, a first pulse-tube side outlet port 25*f*, a second pulse-tube side outlet port 25*g* and a third pulse-tube side outlet port 25*h*. Though outlet ports 25*c*, 25*d* and 25*e* (25*f*, 25*g* and 25*h*) are arranged in an equal spaced manner, in the drawing they are depicted as occupying the same position for easy understanding.

The internal space 251*f* in the housing 25 is in fluid communication with the high pressure inlet port 25*a*, the low pressure inlet port 25*b*, the first regenerator side outlet port 25*c*, the second regenerator side outlet port 25*d*, the third regenerator side outlet port 25*e*, the first pulse-tube side outlet port 25*f*, the second pulse-tube side outlet port 25*g* and the third pulse-tube side outlet port 25*h* by way of passages 251*a*, 251*d*, 251*e*, 251*f*, 251*g* and 251*h*, respectively.

As can be understood from the depiction in FIG. 10, the internal space 251*f* of the housing 251 is divided by a valve seat 252 into a high pressure chamber 251*i* at upper side and a low pressure chamber 251*j* at lower side which are separated with each other in a fluid-tight manner.

The valve seat 252 and the regenerator side rotor 253 are identical with the valve seat 242 shown in FIG. 6 and the rotor 243 shown in FIG. 7, respectively, in construction. The pulse-tube side rotor 254 is also identical with the rotor 243 shown in FIG. 7 except that the former is inverted, unlike the regenerator side rotor 253, when installed. Thus, no further detailed explanation is made with respect to each of the valve seat 252, the regenerator side rotor 253 and the pulse-tube side rotor 254.

A driving motor 256 is accommodated in the low pressure chamber 251*j*, while in the high pressure chamber 251*i* are accommodated the regenerator side rotor 253, the pulse-tube side rotor 254 and the connecting member 255 connecting between the rotors 253 and 254 co-axially and the passage block 258.

A lower surface of the regenerator side rotor 253 is mounted on an upper surface of the valve seat 252 in coaxial manner and is rotatable relative thereto in a sliding mode. When the regenerator side rotor 253 is rotated, its high pressure and low pressure slits (both are not shown) are brought into communication with each of the passages 251*c*, 251*d* and 251*e* via a corresponding passage (not shown) formed in the valve seat 252.

An upper surface of the pulse-tube side rotor 254 is in sliding engagement with a lower surface of the block 258 in co-axial manner. When the pulse-tube side rotor 254 is rotated, its high pressure and low pressure slits (both are not shown) are brought into communication with each of the passages 258*a*, 258*b* and 258*c* which are in fluid communication with the passages 251*f*, 251*g* and 251*h*, respectively.

The driving motor 256 has an output shaft (not shown) which is in alignment connection with the connecting shaft 257 so as to be rotated together therewith. The shaft 257, after passing through the bore 252*c* formed in the rotor 253, is snugly fitted in a blind bore 253*c* of the rotor 253.

In the foregoing structure, when the compressor 1 is driven, the driving motor 256 is also turned on. During the resultant rotation of the output shaft of the driving motor 256, each of the passages in the valve seat 252 is brought in communication with the high pressure and low pressure slits in the rotor 253 in an alternate manner in a predetermined timed relationship, and each of the passages in the block 258 is brought communication with the high pressure and low pressure slits in the rotor 254 in an alternate manner in a predetermined timed relationship. Thus, high pressure and low pressure fluids are supplied in alternation to the operating space of the cryogenic temperature generating device 320, the operating space of the cryogenic temperature generating device 420 and the operating space of the cryogenic temperature generating device 520 from the lines 84*a*, 85*a* and 86*a*, respectively, while the operating fluids are supplied to and sucked from the operating space of the cryogenic temperature generating device 320, the operating space of the cryogenic temperature generating device 420 and the operating space of the cryogenic temperature generating device 520 by way of the respective lines 84*b*, 85*b* and 86*b*. Optimizing supply timing of the operating fluids to both ends of each of the cryogenic generating devices 320, 420 and 520 causes a phase difference between the pressure change and displacement of the operating fluid in each operating space, thereby generating a cryogenic temperature at and around each of the cold heads 322, 422 and 522. Thus substances which are in thermal contact with the respective cold heads 322, 422 and 522 are cooled down.

Due to the fact that the foregoing cryogenic temperature generation is made with the use of the pulse-tube based cryogenic generating device which is void of moving parts near the cold head, the cold head may cool a substance which has to be free from vibrations.

In addition, the cryogenic temperature devices 320, 420 and 520 are allowed to share the sole pressure changeover valve unit 25 in which only one motor 256 is installed, which enables the multi-type pulse-tube refrigerating system to be more compact or miniaturized.

Sixth Embodiment

Figure 11:
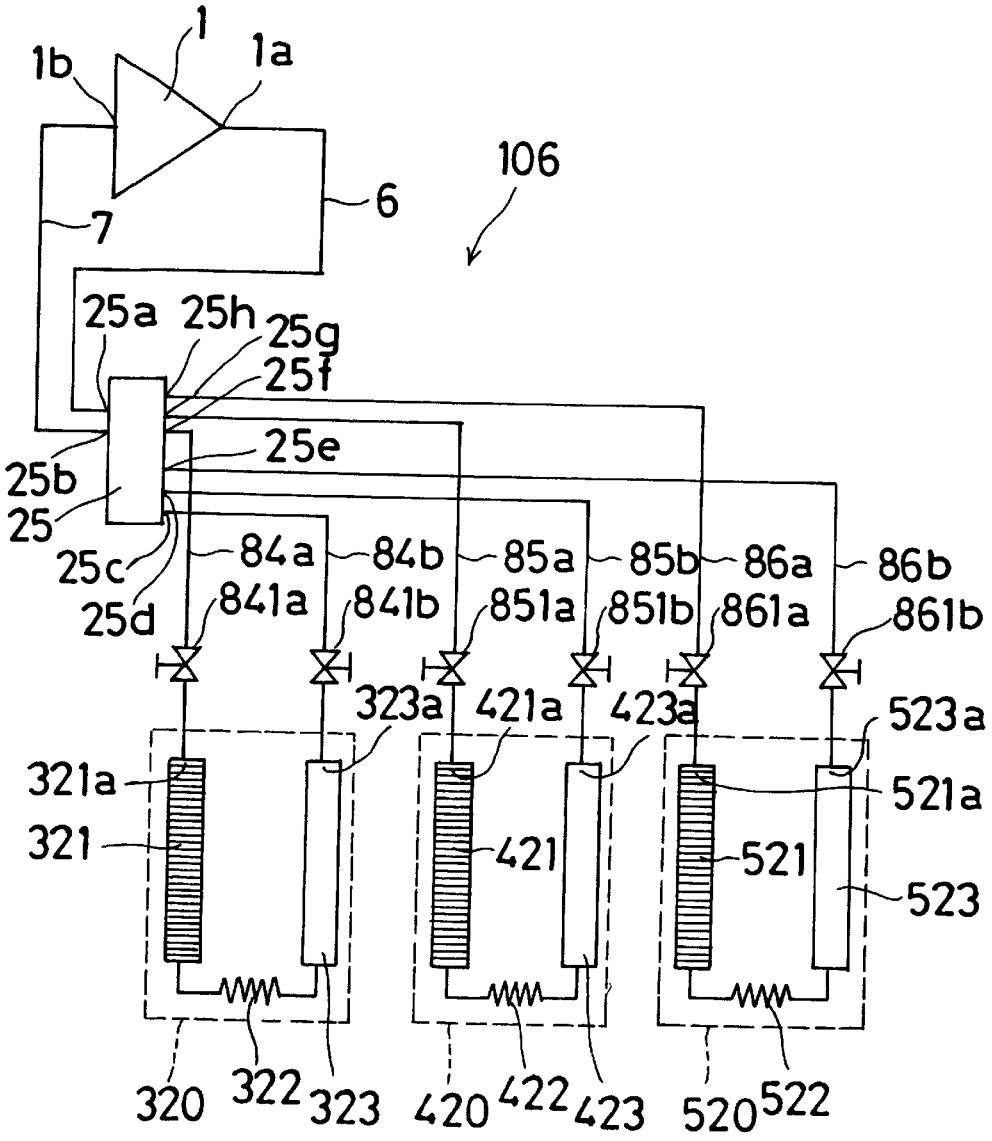
FIG. 11 is a schematic diagram of a multi-type pulse-tube refrigerating system in accordance with a sixth embodiment of the present invention.

With reference to FIG. 11, there is illustrated a multi-type pulse-tube refrigerating system 106 in accordance with a sixth embodiment of the present invention.

This multi-type pulse-tube refrigerating system 106 is constructed in such a manner that a first regenerator side open-close valve 841*a*, a first pulse-tube side open-close valve 841*b*, a second regenerator side open-close valve 851*a*, a second pulse-tube side open-close valve 851*b*, a third regenerator side open-close valve 861*a* and a third pulse-tube side open close valve 861*b* are disposed in the lines 84*a*, 84*b*, 85*a*, 85*b*, 86*a* and 86*b*, respectively, of the multi-type pulse-tube refrigerating system 105 shown in FIG. 9.

The operation and effects of the system 106 are basically identical with those of the system 105 so long as all the open-close valves 841*a*, 841*b*, 851*a*, 851*b*, 861*a* and 861*b* are opened. The merit of providing such open-close valves 841*a*, 841*b*, 851*a*, 851*b*, 861*a* and 861*b* is that while one or two cryogenic generating devices are inoperative with the remaining being in operation, the replacement of a substance to be cooled at the inoperative cryogenic temperature device (s) can be made or the inoperative cryogenic temperature device (s) can be warmed. Wanning the cryogenic temperature device is required before a maintenance operation due to the fact that maintenance of the cryogenic temperature device at a low temperature is difficult. In case the cryogenic temperature device is associated with a cryogenic temperature panel of a cryogenic pump, the cold head of the cryogenic temperature device sometimes has to be warmed up to a temperature for warming the cryogenic panel.

Seventh Embodiment

Figure 12:
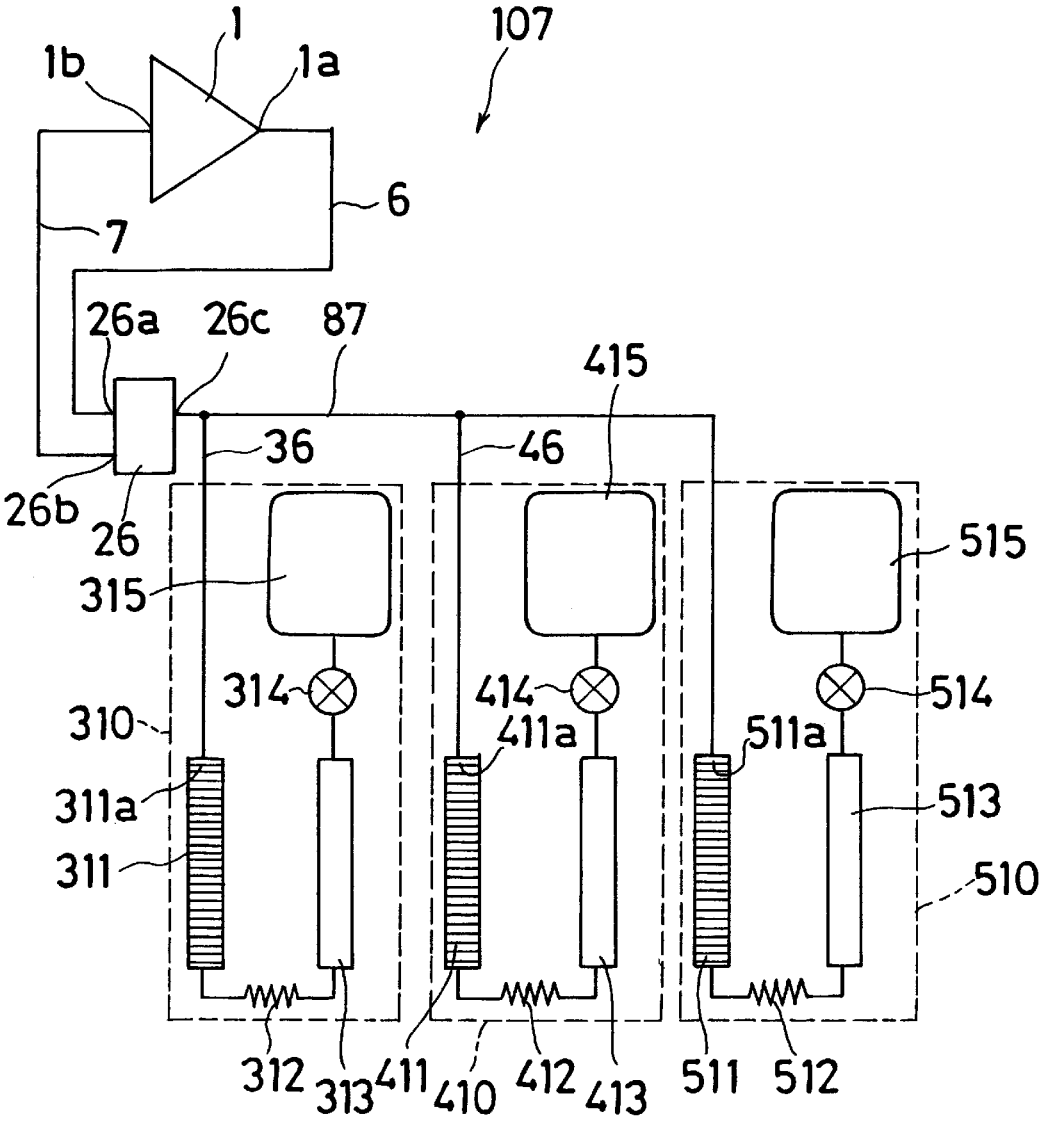
FIG. 12 is a schematic diagram of a multi-type pulse-tube refrigerating system in accordance with a seventh embodiment of the present invention.
Figure 13:
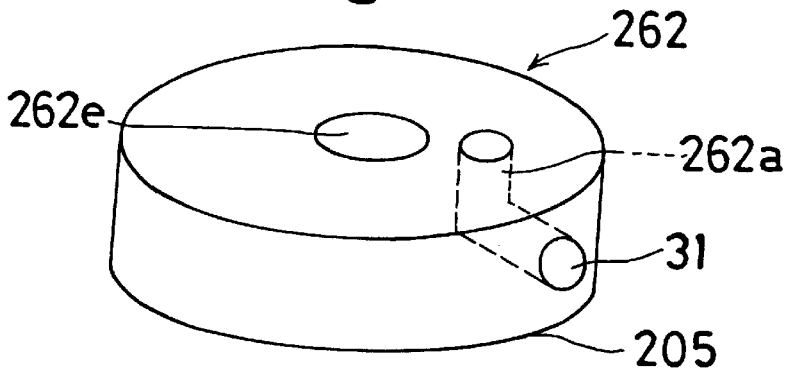
FIG. 13 is a cross-sectional view of a pressure changeover valve unit for use in the multi-type pulse-tube refrigerating system shown in FIG. 12.

With reference to FIG. 12, there is illustrated a multi-type pulse-tube refrigerating system 107 in accordance with a seventh embodiment of the present invention.

The multi-type pulse-tube refrigerating system 107 includes a common compressor 1 having a discharging port 1*a* and a sucking port 1*b*. The discharging port 1*a* of the compressor 1 is connected with a high pressure line 6 which is connected to a high pressure inlet port 26*a* of a common pressure changeover valve unit 26, while the sucking port 1*b* of the compressor 1 is connected with a low pressure line 7 which is connected to a low pressure inlet port 26*b* of the pressure changeover valve unit 26. Thus, by way of the high and low pressure lines 6 and 7, the pressure changeover valve unit 26 is connected across the common compressor 1.

The pressure changeover valve unit 26 also has an outlet port 26*c* which is connected via an output or main line 87 to three paralleled cryogenic temperature generating devices: a first cryogenic temperature generating device 310, a second cryogenic temperature generating device 410 and a third cryogenic temperature generating device 510. The first cryogenic temperature generating device 310 includes a regenerator 311, a cold head 312 to be in thermal engagement with a substance (not shown) for cooling the same, a pulse tube 313, an orifice 314 and a buffer tank 315 which are arranged in such an order. The regenerator 311 is connected at its end 311*a* to the line 87 by way of a first branch line 36 extended therefrom. Thus, first cryogenic temperature generating device 310 is connected to the main line 87.

The second cryogenic temperature generating device 410 includes a regenerator 411, a cold head 412 to be in thermal engagement with a substance (not shown) for cooling the same, a pulse tube 413, an orifice 414 and a buffer tank 415 which are arranged in such an order. The regenerator 411 is connected at its end 411*a* to the line 87 by way of a first branch line 46 extended therefrom. Thus, first cryogenic temperature generating device 410 is connected to the main line 87.

The third cryogenic temperature generating device 510 includes a regenerator 511, a cold head 512 to be in thermal engagement with a substance (not shown) for cooling the same, a pulse tube 513, an orifice 514 and a buffer tank 515 which are arranged in such an order. The regenerator 511 is connected at its end 511*a* to the line 87 by way of a first branch line 56 extended therefrom. Thus, first cryogenic temperature generating device 510 is connected to the main line 87.

The pressure changeover valve unit 26 is basically identical with the pressure changeover valve unit 24 shown in FIG. 5 except that in the former a valve seat 262 is formed with a single passage 262*a*, unlike the valve seat 242 having three passages 242*b*, 242*c* and 242*d*, and correspondingly a single passage connected to the passage 262*a* is formed in the housing. Thus, no further explanation is made with respect to the pressure changeover valve unit 26.

In the foregoing structure, upon turning on the compressor 1, the driving motor housed in the pressure changeover valve unit 26 is also turned on, and alternative high and low pressures are supplied to the operating spaces in the respective cryogenic temperature generating devices 310, 410 and 510. Cryogenic temperatures are generated at and around the respective cold heads 312, 412 and 512 if a phase difference between the resultant pressure change and a displacement of the fluid in the operating space is optimized with the use of the orifices 314, 414 and 514, and the buffer tanks 315, 415 and 515, thereby cooling substances which are in thermal contact with the respective cold heads 312, 412 and 512. It is to be noted that unlike in the system shown in FIG. 5, in this system 107 the branch lines 36, 46 and 56 are supplied with alternately high and low pressures in a synchronized manner.

Due to the fact that the foregoing cryogenic temperature generation is made with the use of the pulse-tube based cryogenic generating device which is void of moving parts near the cold head, the cold head may cool a substance which has to be free from vibrations.

In addition, the cryogenic temperature devices 320, 420 and 520 are allowed to share the sole pressure changeover valve unit 25 in which only one motor 256 is installed, which enables the multi-type pulse-tube refrigerating system to be more compact or miniaturized.

Eighth Embodiment

Figure 14:
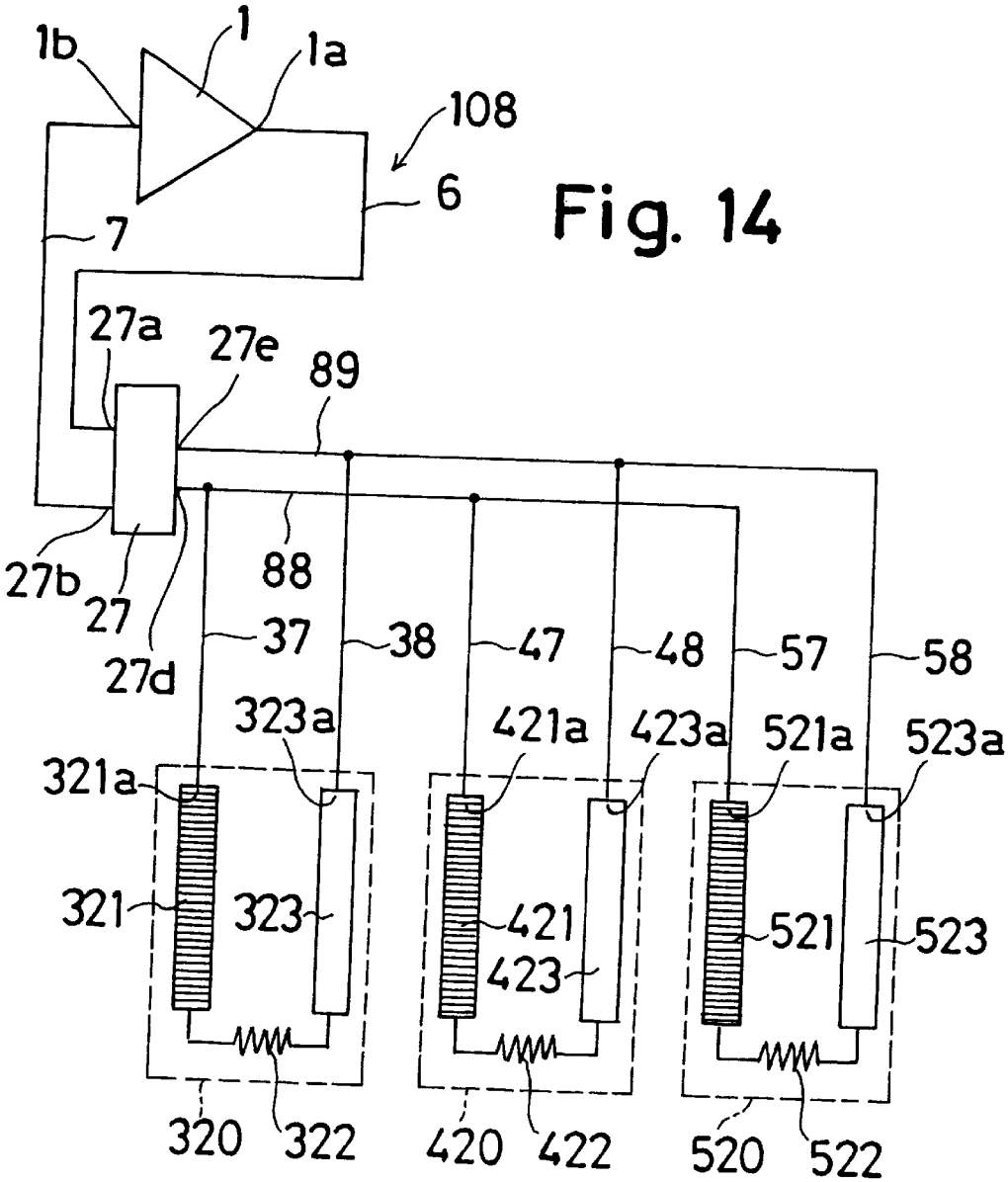
FIG. 14 is a schematic diagram of a multi-type pulse-tube refrigerating system in accordance with a eighth embodiment of the present invention.

With reference to FIG. 14, there is illustrated a multi-type pulse-tube refrigerating system 108 in accordance with an eighth embodiment of the present invention.

The multi-type pulse-tube refrigerating system 108 includes a common compressor 1 having a discharging port 1*a* and a sucking port 1*b*. The discharging port 1*a* of the compressor 1 is connected with a high pressure line 6 which is connected to a high pressure inlet port 27*a* of a common pressure changeover valve unit 27, while the sucking port 1*b* of the compressor 1 is connected with a low pressure line 7 which is connected to a low pressure inlet port 27*b* of the pressure changeover valve unit 27. Thus, by way of the high and low pressure lines 6 and 7, the pressure changeover valve unit 27 is connected across the compressor 1.

The pressure changeover valve unit 27 includes a regenerator side outlet port 27*d* and a pulse-tube side outlet port 27*e* which are connected to a regenerator side output line 88 and a pulse-tube side output line 89, respectively.

The pressure changeover valve unit 27 is connected with three paralleled cryogenic temperature generating devices: a first cryogenic temperature generating device 320, a second cryogenic temperature generating device 420 and a third cryogenic temperature generating device 520.

The first cryogenic temperature generating device 320 includes a series connection of a regenerator 321, a cold head 322 and a pulse tube 323 which are arranged in such an order. An end 321*a* of the regenerator 321 is connected via a line 37 to the line 88, while an end 323*a* of the pulse tube 323 is connected via a line 38 to the line 89.

The second cryogenic temperature generating device 420 includes a series connection of a regenerator 421, a cold head 422 and a pulse tube 423 which are arranged in such an order. An end 421*a* of the regenerator 421 is connected via a line 47 to the line 88, while an end 423*a* of the pulse tube 423 is connected via a line 48 to the line 89.

The third cryogenic temperature generating device 520 includes a series connection of a regenerator 521, a cold head 522 and a pulse tube 523 which are arranged in such an order. An end 521*a* of the regenerator 521 is connected via a line 57 to the line 88, while an end 523*a* of the pulse tube 523 is connected via a line 58 to the line 89.

The pressure changeover valve unit 27 is basically identical with the pressure changeover valve unit 25 shown in FIG. 10 except that in the former a valve seat 262 is formed with a single passage 262*a* unlike the valve seat 242 having three passages 242*b*, 242*c* and 242*d*, and correspondingly a sole passage connected to the passage 262*a* is formed in the housing. Thus, no further explanation is made with respect to the pressure changeover valve unit 26.

In the foregoing structure, when the compressor 1 is driven, the driving motor is also turned on. While the resultant rotation of the output shaft of the driving motor, high pressure and low pressure fluids are alternately supplied to the operating space of the cryogenic temperature generating device 320, the operating space of the cryogenic temperature generating device 420 and the operating space of the cryogenic temperature generating device 520 from a set of the lines 88 and 37, a set of the lines 88 and 47 and a set of the lines 88 and 57, respectively, while the operating fluids are supplied to and sucked from the operating space of the cryogenic temperature generating device 320, the operating space of the cryogenic temperature generating device 420 and the operating space of the cryogenic temperature generating device 520 by way of the respective a set of the lines 38 and 89, a set of the lines 48 and 89 and a set of the lines 58 and 89, respectively. Optimizing supply timing of the operating fluids to both ends of each of the cryogenic generating devices 320, 420 and 520 causes a phase difference between the pressure change and displacement of the operating fluid in each operating space, thereby generating a cryogenic temperature at and around each of the cold heads 322, 422 and 522. Thus substances which are in thermal contact with the respective cold heads 322, 422 and 522 are cooled down.

Due to the fact that the foregoing cryogenic temperature generation is made with the use of the pulse-tube based cryogenic generating device which is void of moving parts near the cold head, the cold head may cool a substance which has to be free from vibrations.

In addition, the cryogenic temperature devices 320, 420 and 520 are allowed to share the sole pressure changeover valve unit 25 in which only one motor 256 is installed, which enables the multi-type pulse-tube refrigerating system to be more compact or miniaturized.

The invention has thus been shown and description with reference to specific embodiments, however, it should be understood that the invention is in no way limited to the details of the illustrates structures but changes and modifications may be made without departing from the scope of the appended claims.

Obviously, numerous modifications and variations of the present invention are possible in light of the above teachings. It is therefore to be understood that within the scope of the appended claims, the invention may be practiced otherwise than as specifically described herein.

What is claimed is:

1. A pulse tube refrigerating system comprising:

a common compressor including a sucking port and a discharging port;

a plurality of pressure changeover valve units connecting in parallel between the sucking port and the discharging port of the common compressor; and a plurality of cryogenic temperature generating devices, each having a pulse-tube and a regenerator which is connected to a respective one of the pressure changeover valve units, wherein each cryogenic temperature generating device is independent of the other cryogenic temperature generating devices.

2. A pulse-tube refrigerating system as set forth in claim 1, further comprising open/close valve means disposed between the common compressor and each of the cryogenic temperature generating devices.

3. A pulse-tube refrigerating system as set forth in claim 1, wherein each of said cryogenic generating devices includes, in order, a series connection of a regenerator, a cold head, a pulse tube, an orifice and a buffer tank.

4. A pulse-tube refrigerating system as set forth in claim 1, wherein each of said cryogenic generating devices includes, in order, a series connection of the regenerator, a cold head and a pulse tube, the series connection being connected across a corresponding pressure changeover valve unit.

5. A pulse tube refrigerating system comprising:

a common compressor including a sucking port and a discharging port;

a plurality of pressure changeover valve units connecting in parallel between the sucking port and the discharging port of the common compressor; and a plurality of cryogenic temperature generating devices, each having a pulse-tube and a regenerator which is connected to a respective one of the pressure changeover valve units, wherein each cryogenic temperature generating device is fluidically isolated from the other cryogenic temperature generating devices, except via a respective one of the pressure changeover valve units.

* * * * *